US011772225B2

(12) United States Patent
Liu

(10) Patent No.: US 11,772,225 B2
(45) Date of Patent: Oct. 3, 2023

(54) PNEUMATIC DEVICE

(71) Applicant: Yueh-Pei Liu, Taichung (TW)

(72) Inventor: Yueh-Pei Liu, Taichung (TW)

( * ) Notice: Subject to any disclaimer, the term of this patent is extended or adjusted under 35 U.S.C. 154(b) by 554 days.

(21) Appl. No.: 17/100,424

(22) Filed: Nov. 20, 2020

(65) Prior Publication Data

US 2022/0161386 A1 May 26, 2022

(51) Int. Cl.
*B24B 27/00* (2006.01)
*B24B 27/033* (2006.01)
*B08B 7/02* (2006.01)

(52) U.S. Cl.
CPC ..... *B24B 27/033* (2013.01); *B08B 7/02* (2013.01)

(58) Field of Classification Search
CPC ..... B24B 27/00
See application file for complete search history.

(56) References Cited

U.S. PATENT DOCUMENTS

2008/0189924 A1* 8/2008 Yonezawa ..... F15B 15/068 74/25

* cited by examiner

*Primary Examiner* — Praachi M Pathak
(74) *Attorney, Agent, or Firm* — Lewis Roca Rothgerber Christie LLP

(57) ABSTRACT

A pneumatic device includes a casing unit defining a first chamber, a receiving space and a front space; a cylinder movably received in the receiving space, defining a second chamber and a releasing room, and having an air passage unit and an annular groove; and a hollow piston rod in sliding engagement with the cylinder, and having an inlet channel, a communicating room and an air hole unit. The cylinder and the piston rod are movable to change between a pneumatic state, where the air hole unit is communicated with the inlet channel, the annular groove, the communicating room and the second chamber, and an air discharging state, where the air passage unit is communicated with the second chamber, the receiving space and the releasing room.

9 Claims, 13 Drawing Sheets

PNEUMATIC DEVICE

FIELD

The disclosure relates to a pneumatic device, and more particularly to a pneumatic device for removing rust, scale or undesirable material on a work surface.

BACKGROUND

Referring to FIG. 1, a conventional pneumatic rust removing gun includes a plurality of steel needles 91, a needle seat 92, a piston 93, a cylinder 94 and an impact block 95. The needle seat 92 is disposed near a front end of the pneumatic rust removing gun. The steel needles 91 are bundled up and are mounted to the needle seat 92. The piston 93 is adapted to be driven by compressed air to reciprocate in the cylinder 94 so as to strike the impact block 95 repetitively. Once the impact block 95 is struck, it strikes the needle holder 92, forcing the steel needles 91 against a work surface. As a result, rust, scale or any undesirable material on the work surface is removed by the back and forth movement of the steel needles 91.

However, when such conventional pneumatic rust removing gun is in use, the repetitive striking movements of the piston 93 and the impact block 95 usually result in generation of strong vibration that can cause discomfort to a user. In order to reduce the vibration, the conventional pneumatic rust removing gun is provided with a rubber pad (not shown) for shock absorption, the effect of which, however, is rather limited.

SUMMARY

Therefore, the object of the disclosure is to provide a pneumatic device that can alleviate the drawback of the prior art.

According to the disclosure, a pneumatic device is adapted to be connected to an air supply device. The pneumatic device includes a casing unit, a cylinder, a hollow piston rod, an impact unit and a resilient member.

The casing unit surrounds an axis, defines a first chamber, a receiving space and a front space that are arranged along the axis, and has an air inlet that is adapted to allow entry of air from the air supply device. The receiving space is disposed between and in spatial communication with the first chamber and the front space.

The cylinder is movably received in the receiving space, and has a surrounding wall, a partition wall, an air passage unit and an annular groove. The surrounding wall surrounds the axis. The partition wall extends in a direction transverse to the axis, and is surrounded by and connected to the surrounding wall such that the partition wall divides an inner space of the surrounding wall into a second chamber opened towards the first chamber, and a releasing room opened towards the front space. The air passage unit is formed in the surrounding wall. The annular groove is indented from an inner surface of the surrounding wall, and is disposed about the axis.

The hollow piston rod movably extends from the first chamber into the second chamber, and is in sliding engagement with the inner surface of the surrounding wall. The piston rod has an inlet channel, a communicating room and an air hole unit. The inlet channel extends along the axis and is in spatial communication with the first chamber. The communicating room is separated from the inlet channel, and is in spatial communication with the second chamber.

The air hole unit is in spatial communication with the inlet channel and the communicating room.

The impact unit is detachably mounted in the releasing room of the cylinder and has an impact portion that is exposed outwardly from the casing unit. The resilient member is disposed in the front space and is connected resiliently between the casing unit and the impact member for pushing the impact unit towards the piston rod.

The cylinder and the piston rod are movable reciprocally relative to each other along the axis to change between a pneumatic state, where the air hole unit spatially communicates the inlet channel with the annular groove, and spatially communicates the annular groove with the communicating room and the second chamber, such that the air is allowed to travel from the inlet channel into the second chamber, so as to move the impact portion of the impact unit away from the casing unit, and an air discharging state, where the air passage unit spatially communicates the second chamber with the receiving space, and spatially communicates the receiving space with the releasing room, such that the air is allowed to travel from the second chamber into the releasing room and to be discharged out of the casing unit, so as to move the impact portion of the impact unit towards the casing unit by restoring action of the resilient member.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
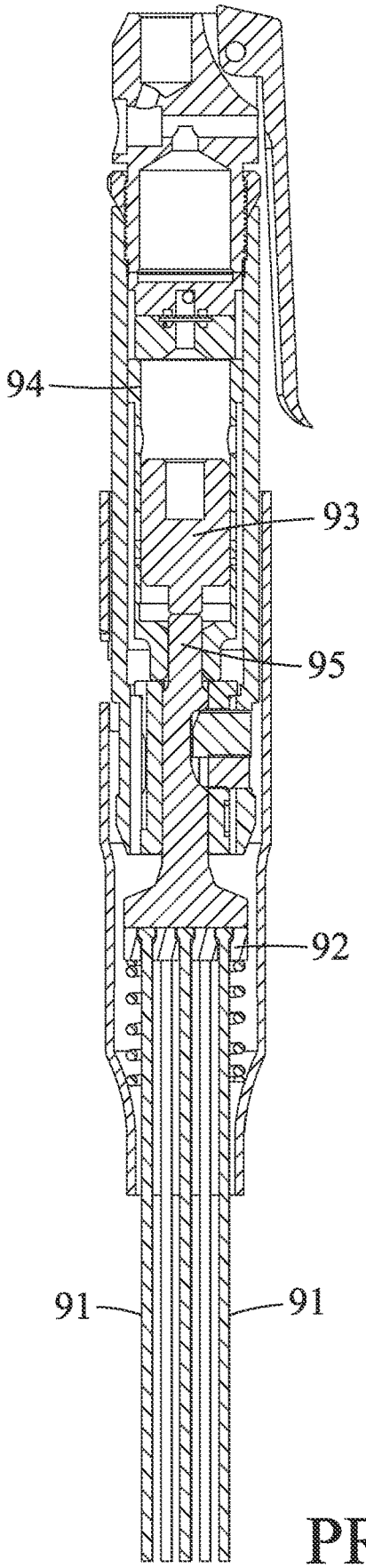
FIG.1 PRIOR ART
FIG. 1 is a sectional view of a conventional pneumatic rust removing gun.

Before the present disclosure is described in greater detail, it should be noted that where considered appropriate, reference numerals or terminal portions of reference numerals have been repeated among the figures to indicate corresponding or analogous elements, may optionally have similar characteristics.

Figure 2:
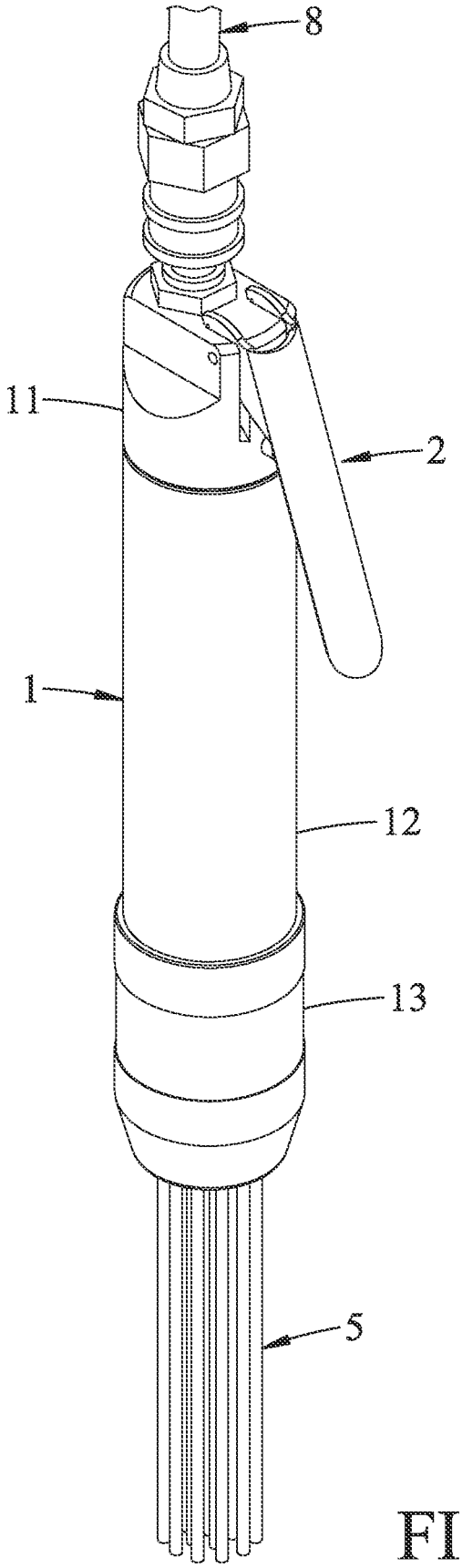
FIG. 2 is a perspective view illustrating a first embodiment of a pneumatic device according to the disclosure connected to an air supply device.
Figure 3:
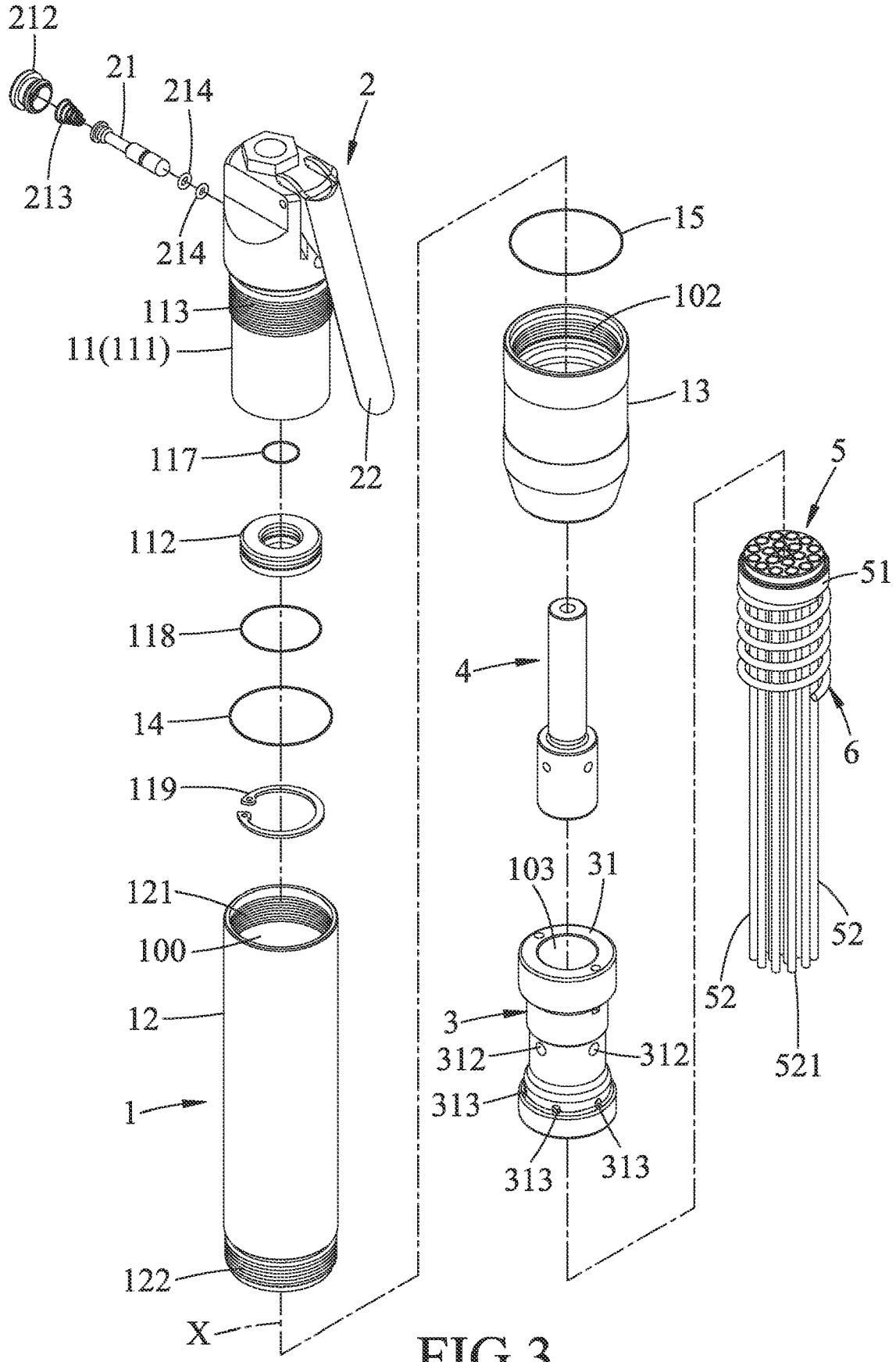
FIG. 3 is an exploded perspective view of the first embodiment.
Figure 4:
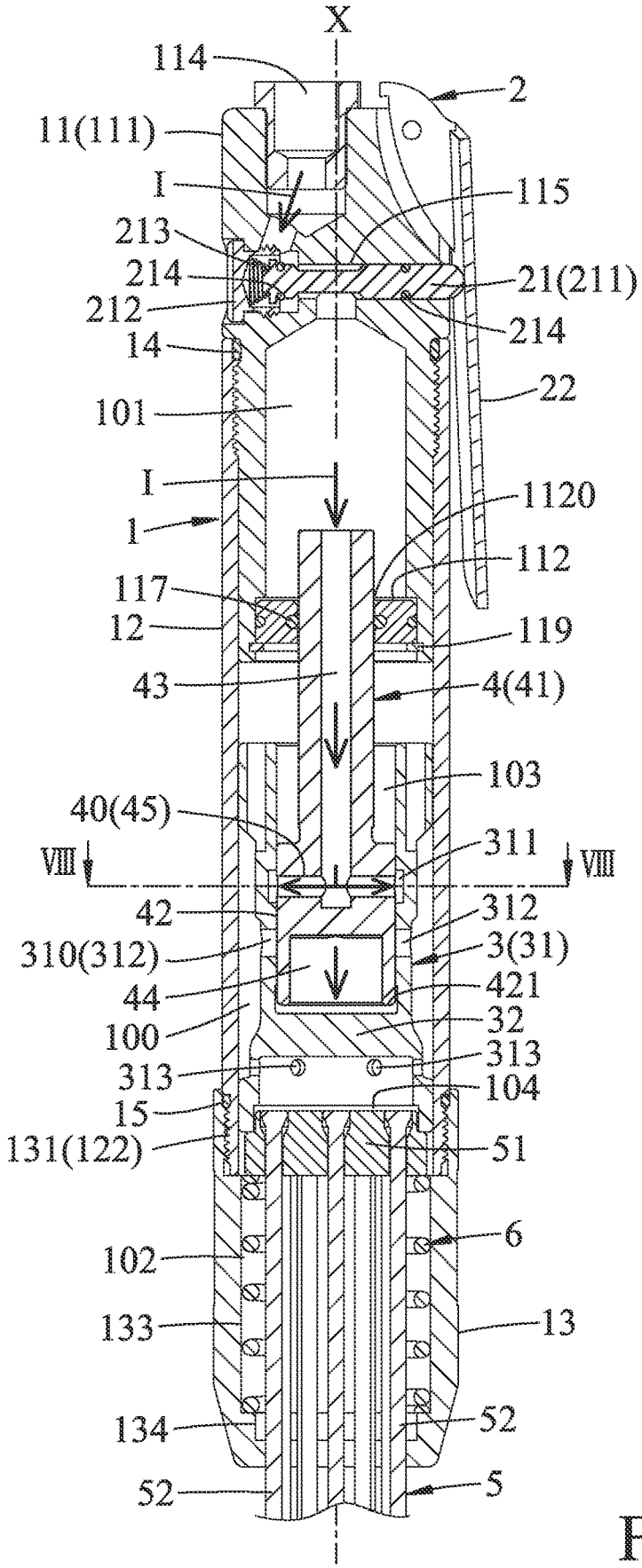
FIG. 4 is a fragmentary sectional view of the first embodiment, illustrating an air valve being pushed by a pressing member, and a piston rod and a cylinder in a pneumatic state.

Referring to FIGS. 2, 3 and 4, a first embodiment of a pneumatic device according to the disclosure is adapted to be connected to an air supply device 8 which discharges compressed air. The pneumatic device includes a casing unit 1, an operating unit 2, a cylinder 3, a hollow piston rod 4, an impact unit 5 and a resilient member 6. In the present embodiment, the pneumatic device is an in-line pneumatic scaler that is user for removing rust, scale or undesirable material on a work surface.

The casing unit 1 surrounds an axis (X), defines a first chamber 101, a receiving space 100 and a front space 102 that are arranged along the axis (X), and has an air inlet 114 that is adapted to allow entry of the compressed air from the air supply device 8. The receiving space 100 is disposed between and in spatial communication with the first chamber 101 and the front space 102.

In the present embodiment, the casing unit 1 includes a handheld member 11, a main tube member 12, a front tube member 13, a first gasket 14 and a second gasket 15.

The main tube member 12 is threadedly and detachably connected to the handheld member 11. The front tube member 13 is threadedly and detachably connected to the main tube member 12. The first gasket 14 is an O-ring, and is disposed between the handheld member 11 and the main tube member 12 so as to establish an airtight seal therebetween. The second gasket 15 is an O-ring, and is disposed between the main tube member 12 and the front tube member 13 so as to establish an airtight seal therebetween.

Figure 5:
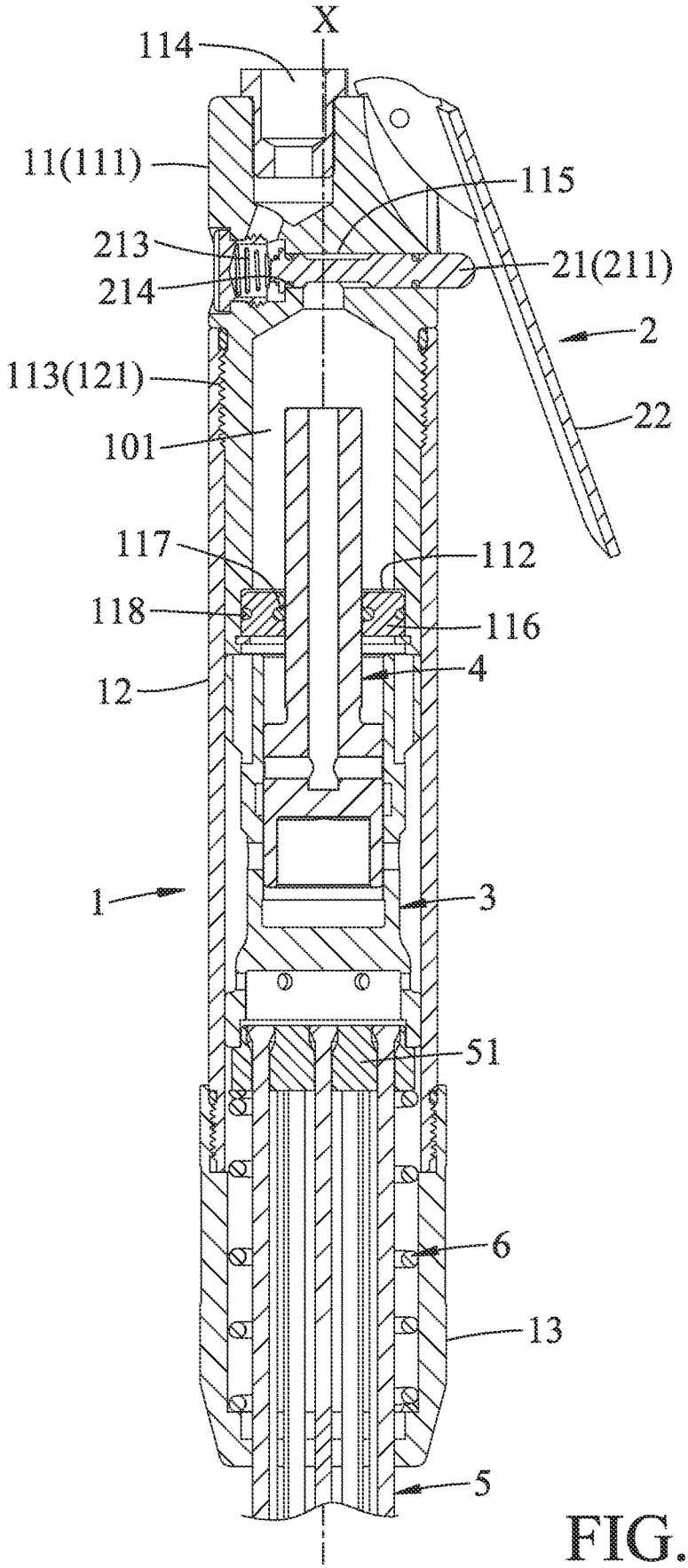
FIG. 5 is a view similar to FIG. 4, illustrating the air valve not being pushed by the pressing member.

Specifically, referring to FIGS. 3, 4 and 5, the handheld member 11 of the casing unit 1 includes a hollow body 111 and a cover component 112. The hollow body 111 is formed with the air inlet 114, and has an open end connected to the cover component 112 such that the hollow body 111 and the cover component 112 cooperatively define the first chamber 101. More specifically, the hollow body 111 is provided with an external thread 113, and is further formed with a valve opening 115 that is disposed between and spatially intercommunicates the air inlet 114 and the first chamber 101, and that further communicates the first chamber 101 with an external environment.

The cover component 112 is disposed between the first chamber 101 and the receiving space 100, is formed with a through hole 1120, and has a main cover 116, an inner airtight ring 117, an outer airtight ring 118 and a retaining ring 119.

The main cover 116 is formed with the through hole 1120. The inner airtight ring 117 surrounds the through hole 1120, and is connected between the main cover 116 and the piston rod 4 so as to establish an air tight seal therebetween. The outer airtight ring 118 surrounds the main cover 116, and is connected between the main cover 116 and the hollow body 111 so as to establish an air tight seal therebetween. The retaining ring 119 is partially embedded in an inner surface of the hollow body 111 and abuts against a bottom end of the main cover 116 for maintaining position of the main cover 116. It should be noted that, in the present embodiment, the inner and outer airtight rings 117, 118 are O-rings that are embedded in the main cover 116, and the retaining ring 119 is a C-type retaining ring (i.e., snap ring or C-clip), but they are not limited thereto.

The main tube member 12 of the casing unit 1 is hollow, has opposite open ends, surrounds the axis (X) and defines the receiving space 100. The main tube member 12 is formed with an internal thread 121 threadedly engaged with the external thread 113 of the handheld member 11, and an external thread 122 opposite to the internal thread 121 along a direction of the axis (X).

The front tube member 13 of the casing unit 1 is hollow, has opposite open ends, surrounds the axis (X) and defines the front space 102. The front tube member 13 has a mounting portion 131, a housing portion 133 and a stopping portion 134 that are arranged along the axis (X). The mounting portion 131 is formed with an internal thread threadedly engaged with the external thread 122 of the main tube member 12. The housing portion 133 defines a stepped inner surface. The main tube member 12 abuts against a shoulder section of the stepped inner surface defined by the housing portion 133.

The operating unit 2 includes a valve assembly 21 and a pressing member 22. The valve assembly 21 includes an air valve 211, a plug piece 212, a conical spring 213 and two third gaskets 214.

The air valve 211 is disposed in the valve opening 115 of the handheld member 11, and is movable to permit or prevent spatial communication between the air inlet 114 and the first chamber 101 (see FIGS. 4 and 5). The plug piece 212 is detachably mounted to the handheld member 11. The conical spring 213 is connected resiliently between the air valve 211 and the plug piece 212. The third gaskets 214 are sleeved on the air valve 211 to establish an airtight seal between the air valve 211 and the handheld member 11.

The pressing member 22 is mounted to the handheld member 11, and is operable to move the air valve 211. Specifically, the pressing member 22 is pivoted to the handheld member 11 for movably abutting against an end portion of the air valve 211 that protrudes from the handheld unit 11 (see FIG. 4). When the pressing member 22 is pressed, the air valve 211 is pushed towards the plug piece 212, permitting the spatial communication between the air inlet 114 and the first chamber 101 via the valve opening 115. When the pressing member 22 is not pressed, the air valve 211 is biased by the conical spring 213 to move away from the plug piece 212, thus blocking the valve opening 115 and preventing the spatial communication between the air inlet 114 and the first chamber 101.

Figure 6:
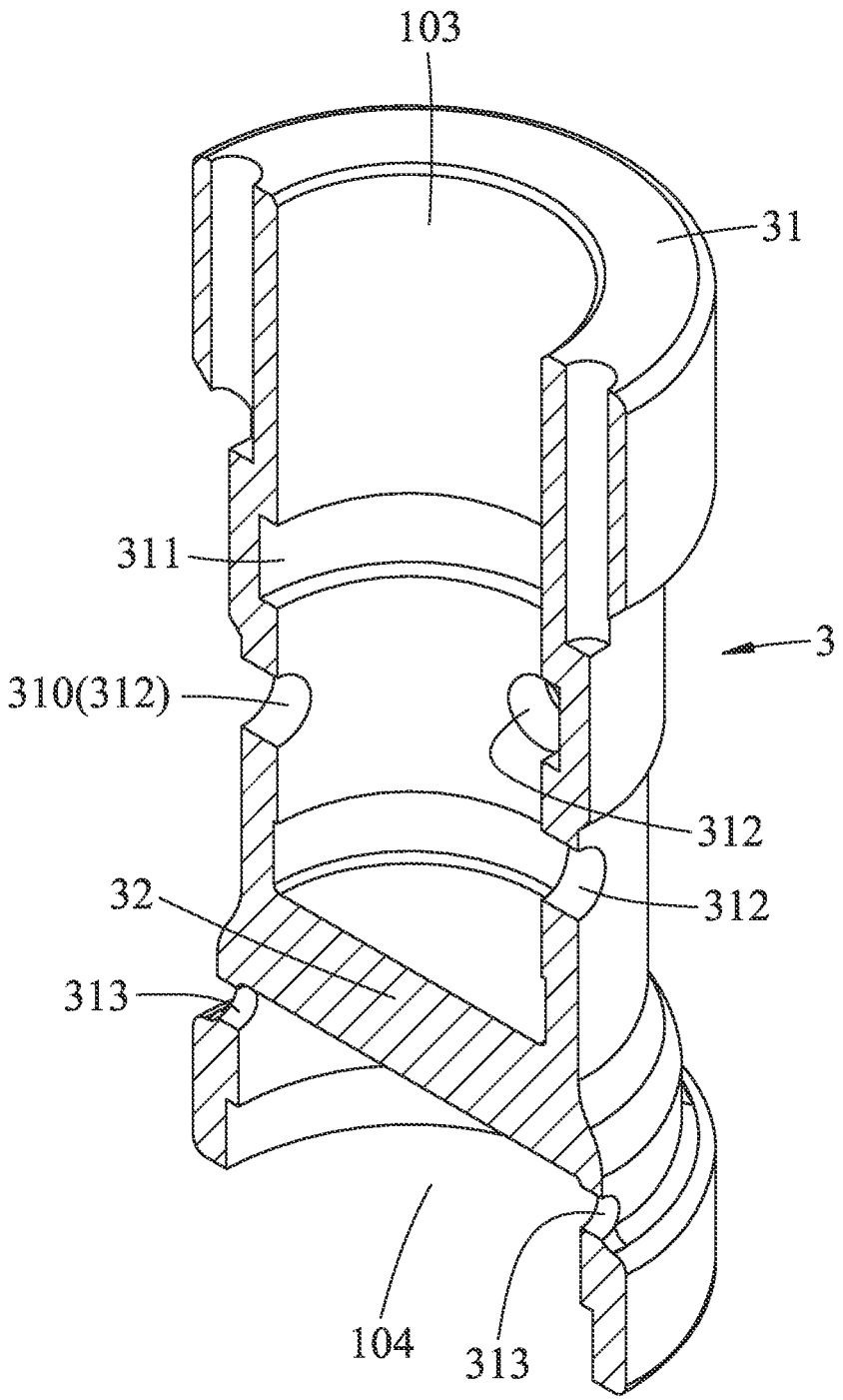
FIG. 6 is a cutaway view of the cylinder of the first embodiment.

Referring to FIGS. 3, 4 and 6, the cylinder 3 is received in the receiving space 100, is movable along the axis (X), and has a surrounding wall 31, a partition wall 32, an air passage unit 310 and an annular groove 311.

The surrounding wall 31 surrounds the axis (X). The partition wall 32 extends in a direction substantially perpendicular to the axis (X), and is surrounded by and connected to the surrounding wall 31 such that the partition wall 32 divides an inner space of the surrounding wall 31 into a second chamber 103 opened towards the first chamber 101, and a releasing room 104 opened towards the front space 102.

The air passage unit 310 is formed in the surrounding wall 31, and includes at least one first passage 312 and at least one second passage 313 that are formed through the surrounding wall 31. The at least one second passage 313 spatially communicates the receiving space 100 with the releasing room 104.

It should be noted that, in the present embodiment, the air passage unit 310 includes four first passages 312 and six second passages 313. The diameter of the second passages 313 is smaller than that of the first passages 312. The first passages 312 are angularly spaced apart from each other with respect to the axis (X). The second passages 313 are also angularly spaced apart from each other with respect to the axis (X). However, numbers and configurations of the first and second passages 312, 313 are not limited to the present embodiment.

The annular groove 311 is indented from an inner surface of the surrounding wall 31, and is disposed about the axis (X). The distance between the annular groove 311 and the releasing room 104 is greater than the distance between the at least one first passage 312 and the releasing room 104.

Figure 7:
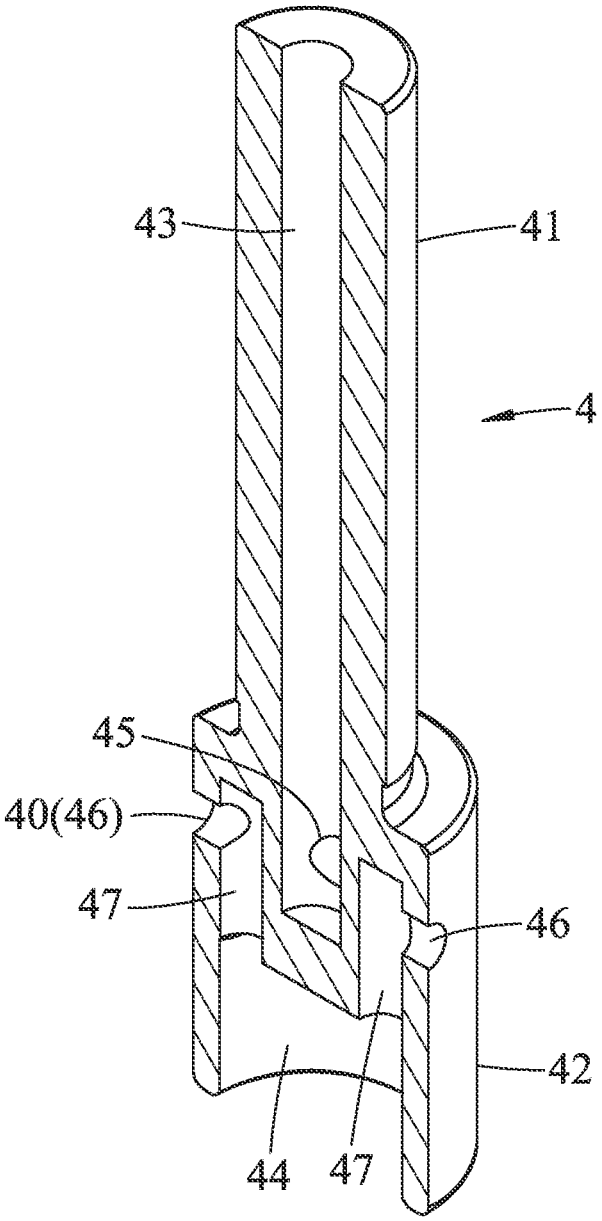
FIG. 7 is a cutaway view of the piston rod of the first embodiment.
Figure 8:
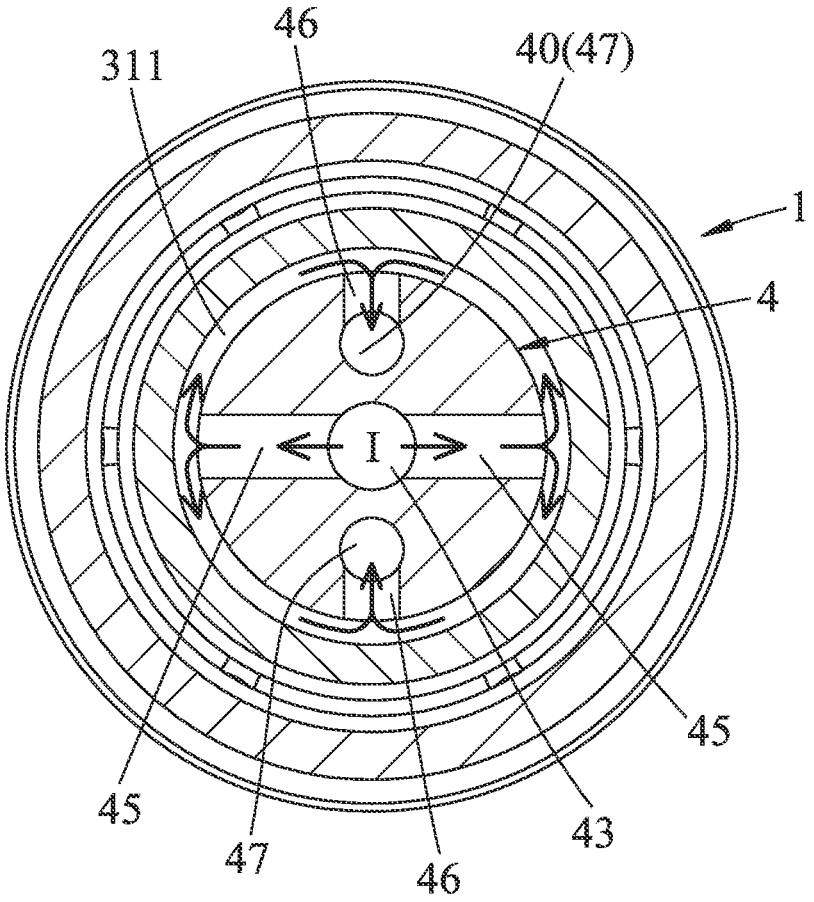
FIG. 8 is a sectional view taken along line VIII-VIII of FIG. 4, illustrating an air hole unit of the piston rod in spatial communication with an annual groove of the cylinder.
Figure 9:
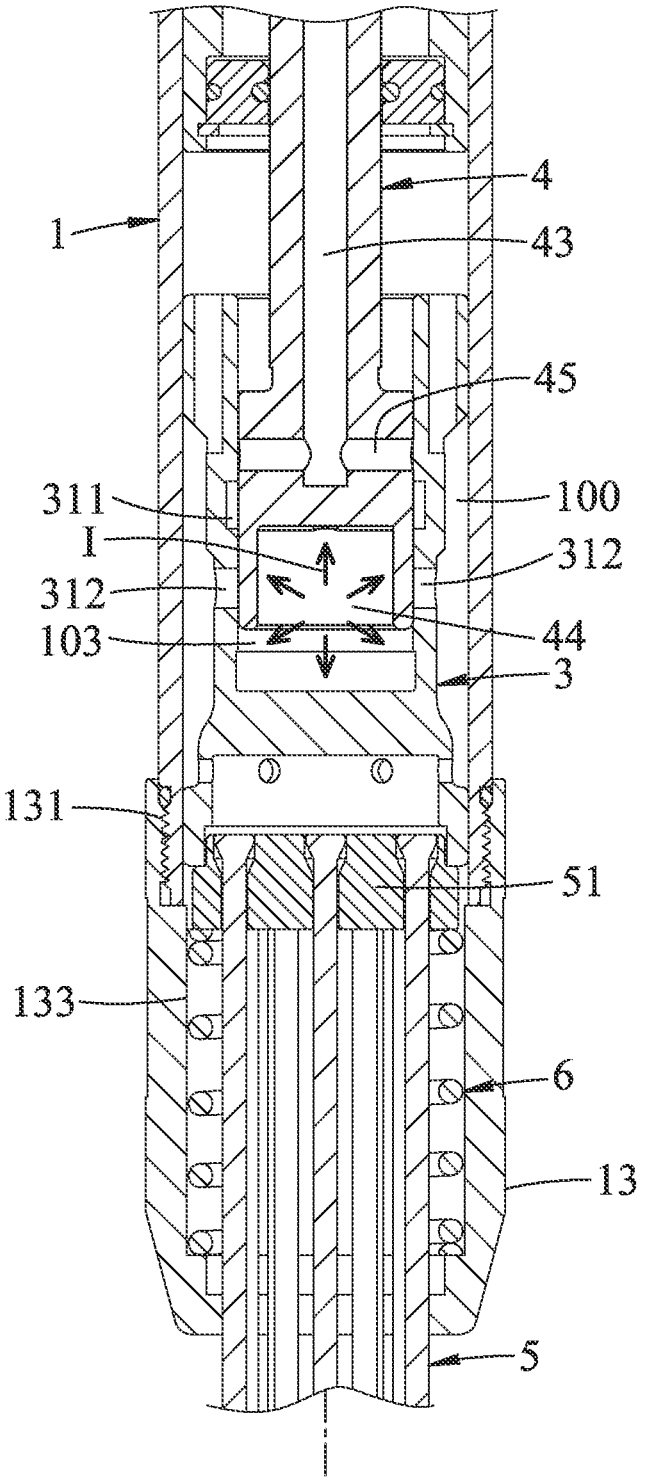
FIG. 9 is a fragmentary sectional view of the first embodiment, illustrating the piston rod and the cylinder in a state between the pneumatic state and an air discharging state.
Figure 10:
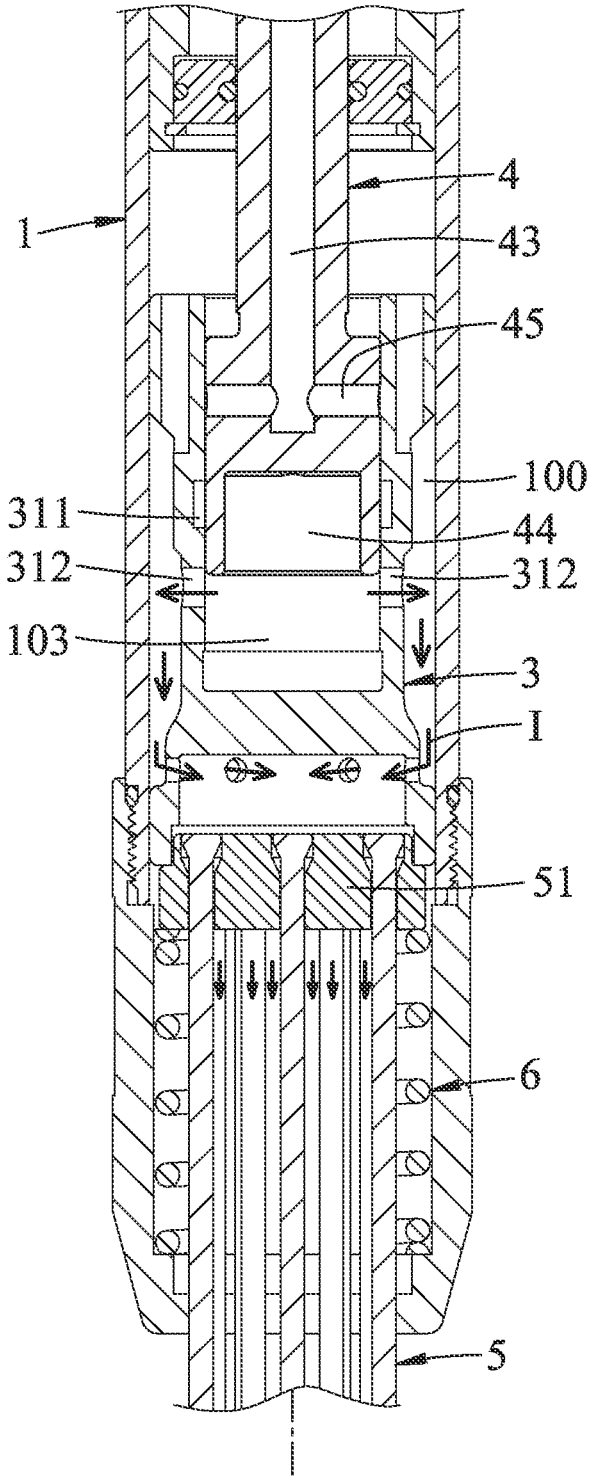
FIG. 10 is a view similar to FIG. 9, illustrating the piston rod and the cylinder in the air discharging state, and a resilient member being compressed.

Referring to FIGS. 4, 7 and 8, the piston rod 4 extends movably from the first chamber 101, through the through hole 1120 of the cover component 112, and into the second chamber 103. Specifically, the piston rod 4 has a first segment 41 and a second segment 42 that are connected along the axis (X). The first segment 41 extends through the through hole 1120 of the cover component 112 and is surrounded by and in sliding contact with the inner airtight ring 117. The second segment 42 is disposed movably in the second chamber 103, and is in sliding engagement with the inner surface of the surrounding wall 31. The outer diameter of the first segment 41 is smaller than that of the second segment 42.

The piston rod 4 further has an channel 43, a communicating room 44 and an air hole unit 40.

The inlet channel 43 extends through the first segment 41, along the axis (X), into the second segment 42, and is in spatial communication with the first chamber 101. The communicating room 44 is formed in the second segment 42, is separated from the inlet channel 43, and is in spatial communication with the second chamber 103.

The air hole unit 40 is in spatial communication with the inlet channel 43 and the communicating room 44, and includes at least one first hole 45, at least one second hole 46 and at least one third hole 47.

Referring specifically to FIG. 7, the at least one first hole 45 is formed through the piston rod 4 and is in spatial communication with the inlet chamber 43. The at least one second hole 46 extends through a wall of the piston rod 4. The at least one third hole 47 extends in the piston rod 4 and spatially communicates the at least one second hole 46 with the communicating room 44. The at least one first hole 45 and the at least one second hole 46 are located in a plane transverse to the axis (X), and are spaced apart from each other, such that the piston rod 4 is movable relative to the cylinder 3 to a position where the annular groove 311 of the cylinder 3 is in spatial communication with the at least one first hole 45 and the at least one second hole 46 (see FIG. 8).

It should be noted that, in the present embodiment, the air hole unit 40 includes two first holes 45, two second holes 46 and two third holes 47. The first and second holes 45, 46 extend radially with respect to the axis (X), and are angularly spaced apart from each other. The third holes 47 extend in a direction of axis (X) and are disposed at opposite sides of the axis (X). However, numbers and configurations of the first, second and third holes 45, 46, 47 are not limited to the present embodiment.

Referring again to FIGS. 3 and 4, the impact unit 5 is detachably mounted in the releasing room 104 of the cylinder 3, and has an impact portion 521 that is exposed outwardly from the casing unit 1. Specifically, the impact unit 5 includes a needle seat 51 and a plurality of metal needles 52. The needle seat 51 is mounted in the releasing room 104 of the cylinder 3. The metal needles 52 are mounted to the needle seat 51, and have front ends that cooperatively constitute the impact portion 521. It should be noted that the metal needles 52 are loosely connected to the needle seat 51 such that the metal needles 52 are allowed to wiggle in the needle seat 51.

The resilient member 6 is disposed in the front space 102 of the casing unit 1, and is connected resiliently between the casing unit 1 and the impact member 5 for pushing the impact unit 5 towards the piston rod 4. In the present embodiment, the resilient member 6 is a coiled compression spring extending along the axis (X), and has opposite ends abutting respectively against the needle seat 51 and the stopping portion 134 of the front tube member 13 of the casing unit 1.

Figure 11:
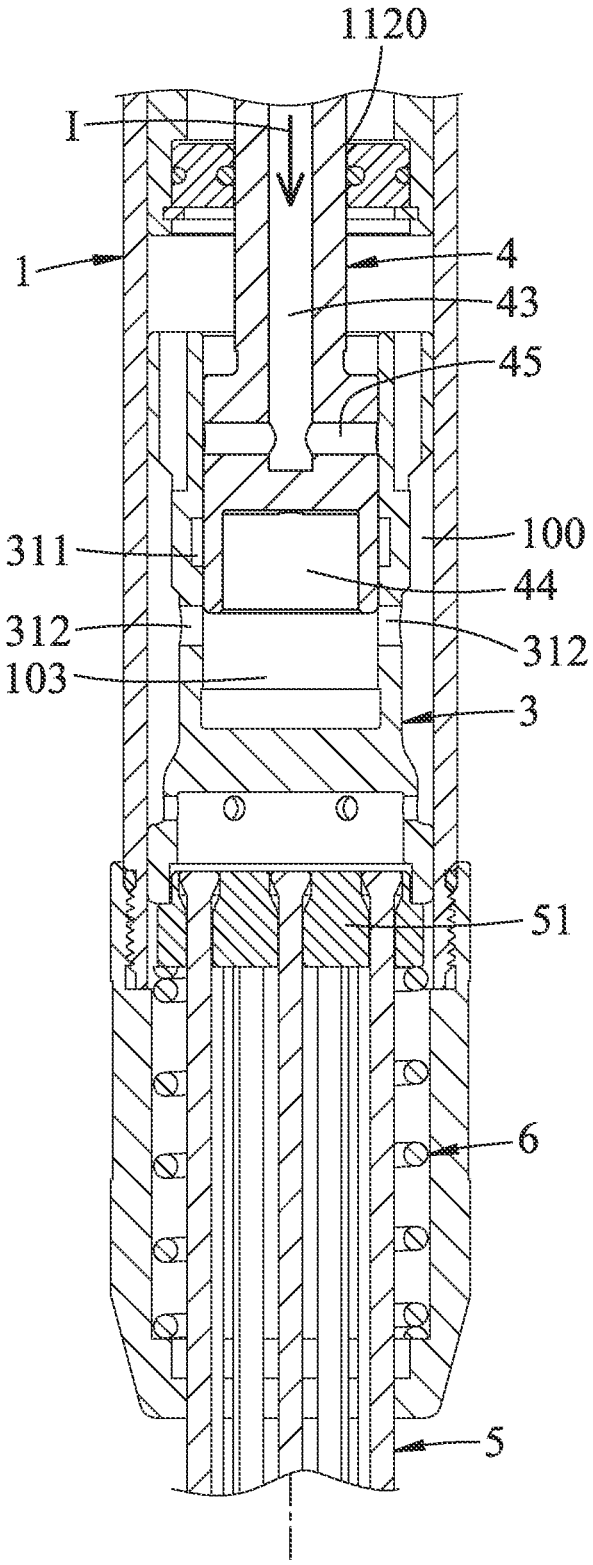
FIG. 11 is a view similar to FIG. 10, illustrating the piston rod and the cylinder in the air discharging state, and the resilient member being less compressed.

Referring to FIGS. 4, 5, 8, 9 and 11, during operation, the cylinder 3 and the piston rod 4 are movable reciprocally relative to each other along the axis (X) to change between a pneumatic state (see FIGS. 4 and 8) and an air discharging state (see FIG. 11).

When the cylinder 3 and the piston rod 4 are in the pneumatic state, the air hole unit 40 spatially communicates the inlet channel 43 with the annular groove 311 and the annular groove with the communicating room 44 and spatially communicates the second chamber 103, such that the air is allowed to travel from the inlet channel 43 into the second chamber 103, so as to move the impact portion 521 of the impact unit 5 away from the casing unit 1.

When the cylinder 3 and the piston rod 4 are in the air discharging state, the air passage 310 spatially communicates the second chamber 103 with the receiving space 100, and the receiving space 100 with the releasing room 104, such that the air is allowed to travel from the second chamber 103 into the releasing room 104 and to be discharged out of the casing unit 1, so as to move the impact portion 521 of the impact unit 5 towards the casing unit 1 by restoring action of the resilient member 6.

Specifically, prior to the operation, the pressing member 22 is not pressed (see FIG. 5). The valve opening 115 is blocked and the compressed air (hereinafter denoted by I, and flowing directions thereof are denoted by arrows in FIGS. 4, 8, 9, 10 and 11) discharged from the air supply device 8 cannot enter the first chamber 101.

To start the operation, the pressing member 22 is pressed toward the casing unit 1, allowing the compressed air (I) to travel from the air inlet 114 into the first chamber 101 and the inlet channel 43. During this period of time, the piston rod 4 is forced by the compressed air (I) towards the releasing room 104.

Once the cylinder 3 and the piston rod 4 come into the pneumatic state (see FIGS. 4 and 8), the annular groove 311 is in communication with the first holes 45 and the second holes 46. The compressed air (I) then flows from the inlet channel 43 through the first holes 45, the annular groove 311, the second holes 46 and the third holes 47, and into the communicating room 44 and the second chamber 103. In this state, the first passages 312 are blocked by the piston rod 4 to prevent spatial communication between the second chamber 103 and the receiving space 100. Thus, as the compressed air (I) is forced into the communicating room 44 and the second chamber 103, increasing air pressure therein, the cylinder 3 and the piston rod 4 begin to move away from each other, so that the needle seat 51 compresses the resilient member 6 and the impact portion 521 hits the work surface.

It should be noted that, when the cylinder 3 and the piston rod 4 come into the air discharging state (see FIGS. 10 and 11), the first passages 312 are unblocked by the piston rod 4 to allow spatial communication between the second chamber 103 and the receiving space 100. The compressed air (I) flows from the second chamber 103 and the communicating room 44 through the first passages 312, the receiving space 100, the second passages 313 and the releasing room 104, and is finally discharged out of the casing unit 1 through gaps between the needle seat 51 and the metal needles 52 (see FIG. 10). As a result, the air pressure in the communicating room 44 and the second chamber 103 drops, and the resilient member 6 is allowed to restore and push the needle seat 51 and the cylinder 3 towards the first chamber 101. At this time, the compressed air (I) discharged continuously from the air supply device 8 into the inlet channel 43 will again push the piston rod 4 towards the releasing room 104, repeating the whole operation.

Through repetition of the abovementioned process, the impact portion 521 is able to remove rust, scale or undesirable material from the work surface.

Figure 12:
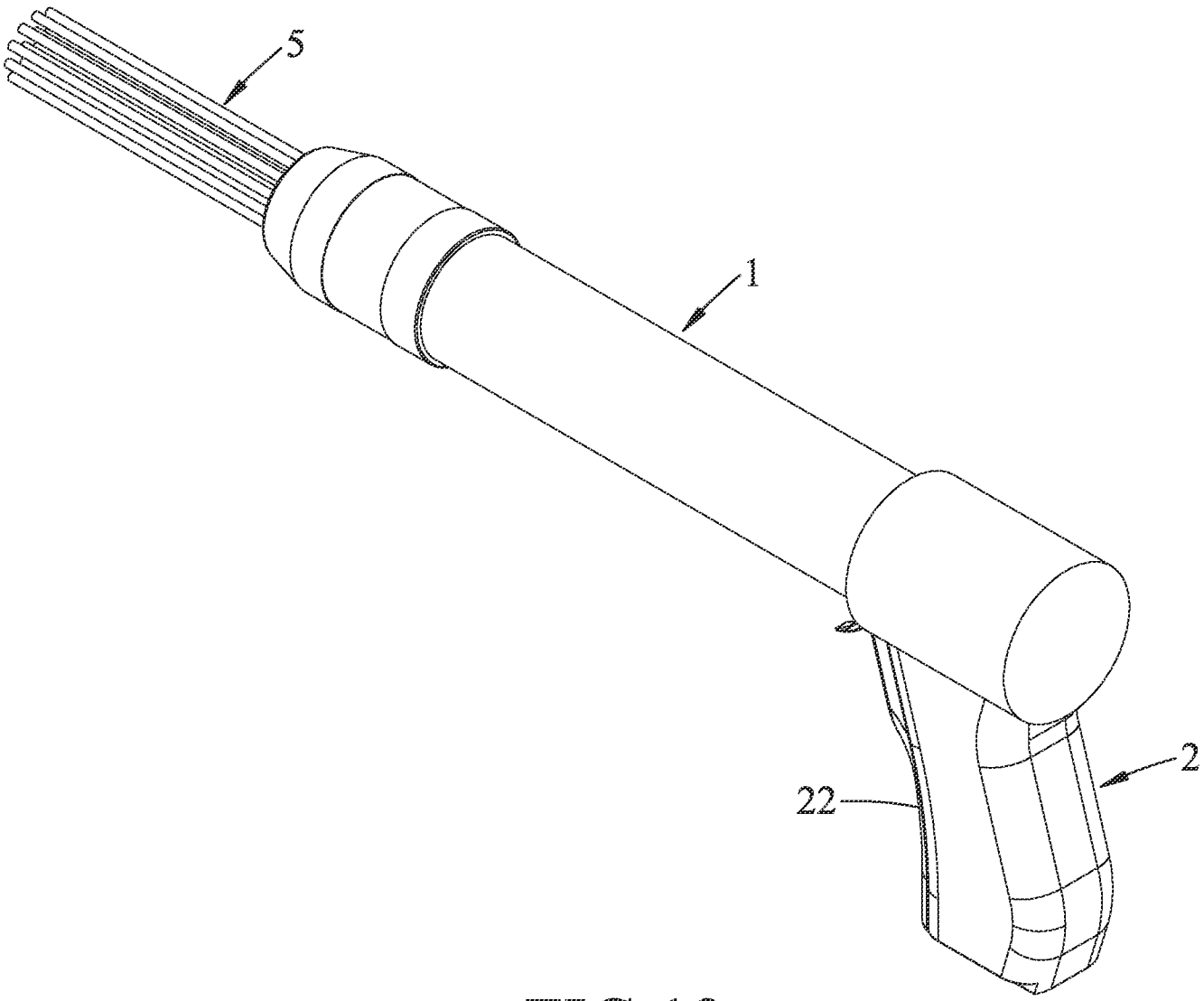
FIG. 12 is a perspective view of a second embodiment of the pneumatic device according to the disclosure.

Referring to FIG. 12, a second embodiment of the pneumatic device according to the disclosure is similar to the first embodiment. The difference between the two resides in that, in the second embodiment, the pressing member 22 of the operating unit 2 is configured as a hand grip such that the pneumatic device resembles a pistol and provides a better grip in certain applications.

Figure 13:
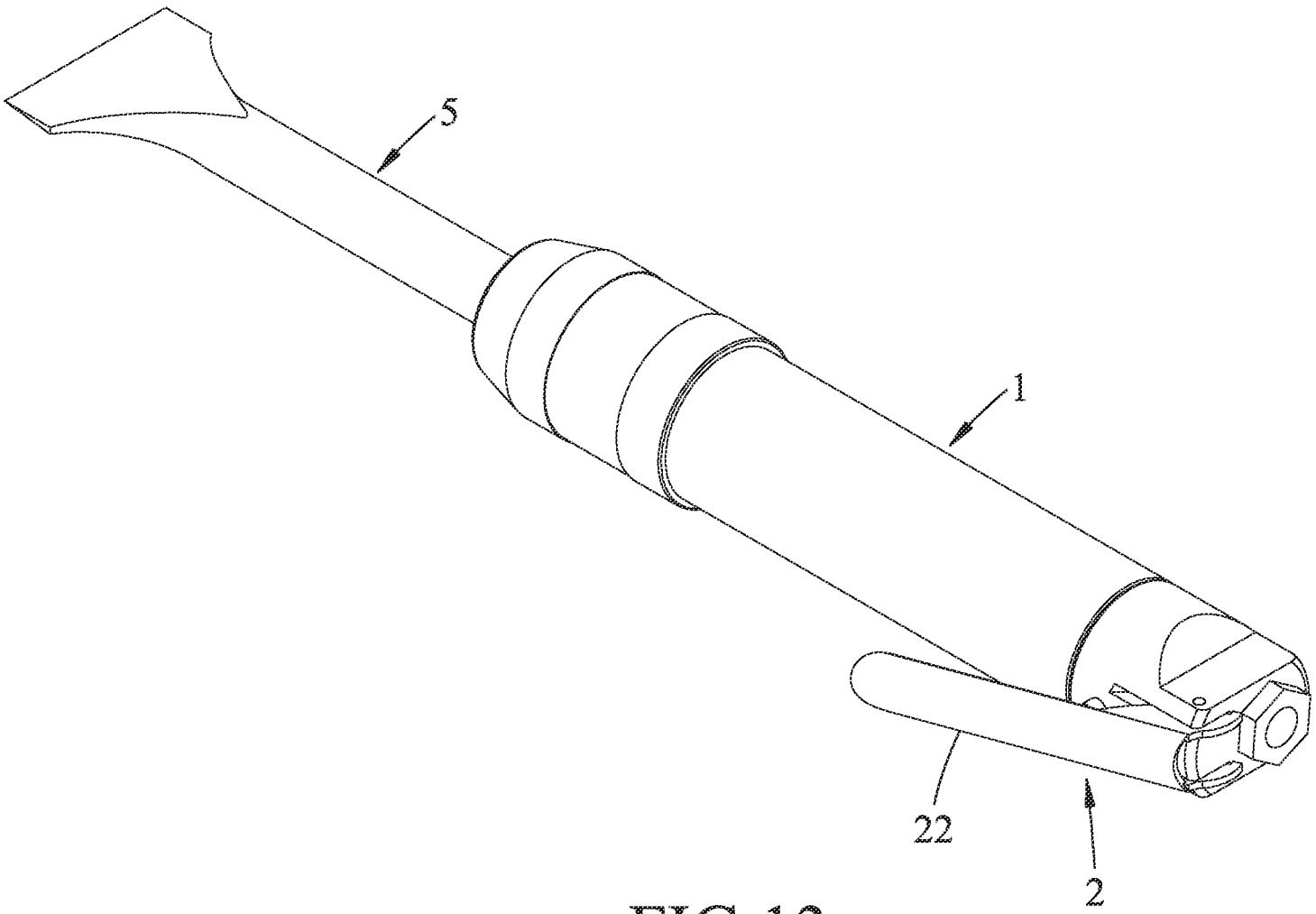
FIG. 13 is a perspective view of a third embodiment of the pneumatic device according to the disclosure.

Referring to FIG. 13, a third embodiment of the pneumatic device according to the disclosure is similar to the first embodiment. The difference between the two resides in that, in the third embodiment, the impact unit 5 is a chisel, which is suitable for removing rust or scale from larger work surfaces.

In sum, in virtue of configurations of the air passage unit 310 of the cylinder 3 and the air hole unit 40 of the piston rod 4 and disposition first and second chambers 101, 103, the pneumatic device of the present disclosure has a better shock absorbing effect than does the prior art, and vibration during the operation can be effectively reduced.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A pneumatic device adapted to be connected to an air supply device, said pneumatic device comprising:

a casing unit surrounding an axis, defining a first chamber, a receiving space and a front space that are arranged along the axis, and having an air inlet that is adapted to allow entry of air from the air supply device, said receiving space being disposed between and in spatial communication with said first chamber and said front space;

a cylinder movably received in said receiving space, and having a surrounding wall that surrounds the axis, a partition wall that extends in a direction transverse to the axis, and that is surrounded by and connected to said surrounding wall such that said partition wall divides an inner space of said surrounding wall into a second chamber opened towards said first chamber, and a releasing room opened towards said front space, an air passage unit that is formed in said surrounding wall, and an annular groove that is indented from an inner surface of said surrounding wall, and that is disposed about the axis;

a hollow piston rod movably extending from said first chamber into said second chamber, and being in sliding engagement with said inner surface of said surrounding wall, said piston rod having an inlet channel that extends along the axis and that is in spatial communication with said first chamber, a communicating room that is separated from said inlet channel, and that is in spatial communication with said second chamber, and an air hole unit in spatial communication with said inlet channel and said communicating room;

an impact unit detachably mounted in said releasing room of said cylinder and having an impact portion that is exposed outwardly from said casing unit; and a resilient member disposed in said front space and connected resiliently between said casing unit and said impact member for pushing said impact unit towards said piston rod;

wherein said cylinder and said piston rod are movable reciprocally relative to each other along the axis to change between a pneumatic state, where said air hole unit spatially communicates said inlet channel with said annular groove and spatially communicates said annular groove with said communicating room and said second chamber, such that the air is allowed to travel from said inlet channel into said second chamber, so as to move said impact portion of said impact unit away from said casing unit, and an air discharging state, where said air passage unit spatially communicates said second chamber with said receiving space, and spatially communicates said receiving space with said releasing room, such that the air is allowed to travel from said second chamber into said releasing room and to be discharged out of said casing unit, so as to move said impact portion of said impact unit towards said casing unit by restoring action of said resilient member.

2. The pneumatic device as claimed in claim 1, wherein said air passage unit includes:

at least one first passage formed through said surrounding wall such that, when said cylinder and said piston rod are in the pneumatic state, said at least one first passage is blocked by said piston rod to prevent spatial communication between said second chamber and said receiving space, and when said cylinder and said piston rod are in the air discharging state, said at least one first passage is unblocked by said piston rod to allow spatial communication between said second chamber and said receiving space; and at least one second passage formed through said surrounding wall to spatially communicate said receiving space with said releasing room.

3. The pneumatic device as claimed in claim 2, wherein a distance between said annular groove and said releasing room is greater than a distance between said at least one first passage and said releasing room.

4. The pneumatic device as claimed in claim 1, wherein: said air hole unit includes at least one first hole formed through said piston rod and in spatial communication with said inlet chamber, at least one second hole extending through a wall of said piston rod, and at least one third hole that extending in said piston rod and that spatially communicate said at least one second hole with said communicating room, said at least one first hole and said at least one second hole being located in a plane transverse to the axis, and being spaced apart from each other, such that said piston rod is movable relative to said cylinder to a position where said annular groove is in spatial communication with said at least one first hole and said at least one second hole when said cylinder and said piston rod are in the pneumatic state.

5. The pneumatic device as claimed in claim 1, wherein said casing unit includes:

a handheld member defining said first chamber and having said air inlet;

a main tube member defining said receiving space, and threadedly and detachably connected to said handheld member; and a front tube member defining said front space, and threadedly and detachably connected to said main tube member.

6. The pneumatic device as claimed in claim 5, wherein said casing unit further includes a first gasket disposed between said handheld member and said main tube member, and a second gasket disposed between said main tube member and said front tube member.

7. The pneumatic device as claimed in claim 5, wherein said handheld member includes:

a cover component that is disposed between said first chamber and said receiving space, and that is formed with a through hole, said piston rod movably extending through said through hole of said cover component; and a hollow body that has an open end connected to said cover component such that said hollow body and said cover component cooperatively define said first chamber.

8. The pneumatic device as claimed in claim 7, wherein said cover component has:

a main cover that is formed with said through hole;

an inner airtight ring that surrounds said through hole, and that is connected between said main cover and said piston rod so as to establish an air tight seal therebetween; and an outer airtight ring that surrounds said main cover, and that is connected between said main cover and said hollow body so as to establish an air tight seal therebetween.

9. The pneumatic device as claimed in claim 5, further comprising an operating unit including:

an air valve mounted to said handheld member, and being movable to permit or prevent spatial communication between said air inlet and said first chamber; and a pressing member mounted to said handheld member, and being operable to move said air valve.

* * * * *